US006023251A

United States Patent [19]

Koo et al.

[11] Patent Number: 6,023,251

[45] Date of Patent: Feb. 8, 2000

[54] CERAMIC CHIP ANTENNA

[75] Inventors: Ki-Duk Koo, Seoul; Dong-Seok Chang, Kyungki-do; Jae-Suk Sung, Seoul; Woo-Sung Lee, Kyungki-do, all of Rep. of Korea

[73] Assignee: Korea Electronics Technology Institute, Pyungtaek-Si, Rep. of Korea

[21] Appl. No.: 09/175,700

[22] Filed: Oct. 20, 1998

[30] Foreign Application Priority Data

Jun. 12, 1998 [KR] Rep. of Korea ..... 98-21898
Jun. 12, 1998 [KR] Rep. of Korea ..... 98-21899

[51] Int. Cl.[7] ..... H01Q 1/36

[52] U.S. Cl. ..... 343/895; 343/700 MS; 343/873; 343/702

[58] Field of Search ..... 343/895, 702, 343/700 MS, 873; H01Q 1/36

[56] References Cited

U.S. PATENT DOCUMENTS 5,861,852 1/1999 Asakura et al. ..... 343/702
5,870,065 2/1999 Kanba et al. ..... 343/895
5,870,066 2/1999 Asakura et al. ..... 343/895

*Primary Examiner*—Don Wong
*Assistant Examiner*—Shih-Chao Chen
*Attorney, Agent, or Firm*—Alston & Bird LLP

[57] ABSTRACT

A ceramic chip antenna is provided which exhibits a small size and is capable of utilizing a plurality of bands. The ceramic chip antenna comprises a dielectric chip base, a plurality of main conductors which is spirally wound within said dielectric chip base, and a plurality of sub conductors which is spirally wound within each of said main conductors. The sub conductors are respectively separated. One ends of said main conductors are led to an outside surface of said dielectric base to form feeding terminal for applying a signal to said main conductors and one ends of said sub conductors are led to an outside surface of said dielectric base to form feeding terminal for applying a signal to said sub conductors.

14 Claims, 12 Drawing Sheets

CERAMIC CHIP ANTENNA

BACKGROUND OF THE INVENTION (a) Field of the Invention

The present invention relates to a chip antenna, and more particularly, to a ceramic chip antenna capable of utilizing a plurality of bands since spirally wound conductors operating at each other different frequencies is formed within the ceramic chip.

(b) Description of the Prior Arts

FIG. 1A is a representation of a conventional dipole antenna. As shown in FIG. 1A, a conventional dipole antenna includes two-quarter wavelength dipoles 1 and 3. The dipole antenna was quite acceptable as antennas for low frequency fixed station transceivers. The dipole antenna has the advantage of a relatively large bandwidth. However, with the advent of portable transceivers operating at relatively high frequencies, the large size of the dipole antenna with respect to the relatively small size of the portable transceiver makes such dipole antenna impractically large for employment on such a transceiver. Unfortunately, the size of the dipole antenna is too large to be aesthetically acceptable with respect to the modern relatively small portable transceivers.

FIG. 1B is a side view of a conventional helical antenna. As shown in FIG. 1B, a conventional helical antenna includes a cylindrical support member 5. The support member 5 is composed of an electrically insulative material. A conductor 7 is spirally wound around the portion of the support member 5. Here, a resonating frequency is determined by the number of turnings, the interval of turnings, and the length of the conductor 7. Since the size of the helical antenna is relatively small, the helical antenna is acceptable with respect to the small portable transceivers. However, the helical antenna operating at single band is not suitable for a portable transceiver operating at two bands.

FIG. 1C is a side view of a conventional dual band helical antenna. As shown in FIG. 1C, a conventional dual band helical antenna includes a cylindrical support member 9. The support member 9 is comprised of an electrically insulative material. A conductor 15 of electrically conductive material is spirally wound around the upper portion 11 of the support member 9. A conductor 17 of electrically conductive material is spirally wound around the lower portion 13 of the support member 9. Accordingly, the dual band helical antenna is suitable for a transceiver operating at two bands.

Typically, a helical antenna is retractably formed on the top plane of a portable transceiver. Then, a user uses the portable transceiver after drawing out the helical antenna from the transceiver and keeps the transceiver after putting the helical antenna in the transceiver. Since the helical antenna is projected from the top plane of the transceiver, the helical antenna is easy to break and is unhandy to carry about. Also, the relatively large size of the helical antenna makes difficult to get smaller with respect to the size of the portable transceiver.

One solution to the above antenna problem is to form a chip antenna inside of a portable transceiver. The chip antenna is manufactured by utilizing a ceramic chip manufacturing technology.

FIG. 2 is a perspective view of a conventional ceramic chip antenna. As shown in FIG. 2, a conventional ceramic chip antenna has a ceramic chip 19 formed as a rectangular parallelepiped and a conductor which is spirally wound inside the ceramic chip 19. The conductor includes horizontal strip patterns 21 which is formed by printing and is parallel to a mounting surface 25 of the ceramic chip 19, and perpendicular strip patterns 23 formed by filling via holes being perpendicular to the mounting surface 25 with electrically conductive paste. Further, one end of the conductor is led to an outside surface of the ceramic chip 19 to form a feeding terminal for applying a signal to the conductor. FIG. 3 is a return loss vs. frequency graph of the ceramic chip antenna. Such graph shows a rather sharp peak in return power loss at predetermined frequency fo and thus the ceramic chip antenna is usable for operating in only a relatively narrow bandwidth centered around the frequency fo.

However, the ceramic chip antenna would not be suitable for a portable transceiver operating at two bands or more.

SUMMARY OF THE INVENTION

It is an object of the present invention to provide a ceramic chip antenna capable of utilizing a plurality of bands.

Another object of the present invention is to provide a ceramic chip antenna exhibiting a size sufficiently small to be contained inside of small portable transceivers.

Another object of the present invention is to provide a ceramic chip antenna which exhibits a relatively wide bandwidth.

To achieve the object and in accordance with the purpose of the invention, as embodied and broadly described herein, the invention comprises a dielectric base and a plurality of conductors which is spirally formed within the dielectric base.

Here, each of the conductors is separated and one ends of the conductors are led to an outside surface of the dielectric base to form a feeding terminal for applying a signal to the conductors.

Also, to achieve this object, the present invention comprises a dielectric base, a plurality of main conductors which is spirally formed within the dielectric base, and a plurality of sub conductors which is spirally formed within the main conductors.

Here, each of the sub conductors is separated. One ends of each of the main conductors are led to an outside surface of the dielectric base to form a feeding terminal for applying a signal to the main conductors. Further, one ends of each of the sub conductors are led to an outside surface of the dielectric base to form a feeding terminal for applying a signal to the sub conductors.

BRIEF DESCRIPTION OF THE DRAWINGS

The accompanying drawings, which are incorporated in and constitute a part of this specification, illustrate one embodiment of the invention and, together with the description, serve to explain the principles of the invention. In the drawings.

DETAILED DESCRIPTION OF THE PREFERRED EMBODIMENTS

Reference will now be made in detail to the present preferred embodiment of the invention, an example of which is illustrated in the accompanying drawings.

Figure 1A:
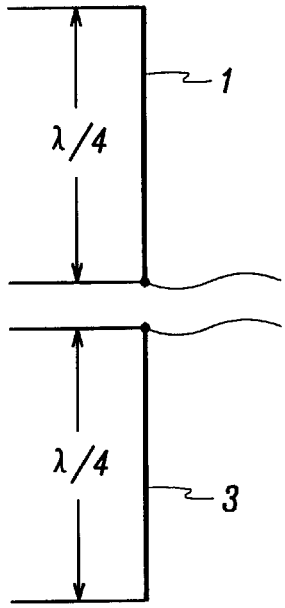
FIG. 1a (PRIOR ART)
FIG. 1A is a representation of a conventional dipole antenna.
Figure 1B:
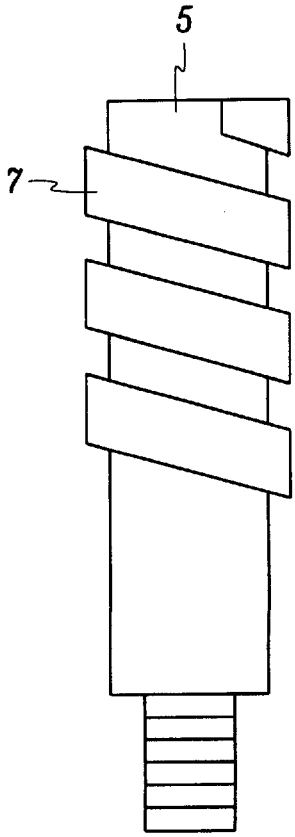
FIG. 1b (PRIOR ART)
FIG. 1B is a side view of a conventional helical antenna.
Figure 1C:
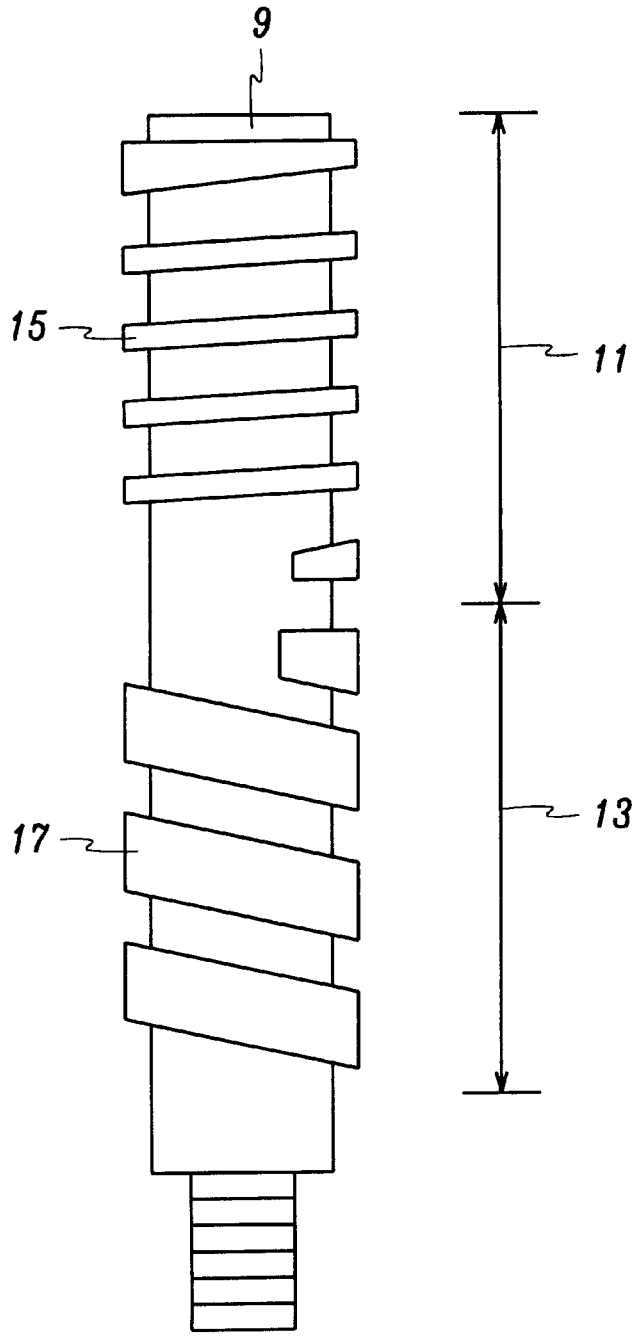
FIG. 1c (PRIOR ART)
FIG. 1C is a side view of a conventional dual band helical antenna.
Figure 2:
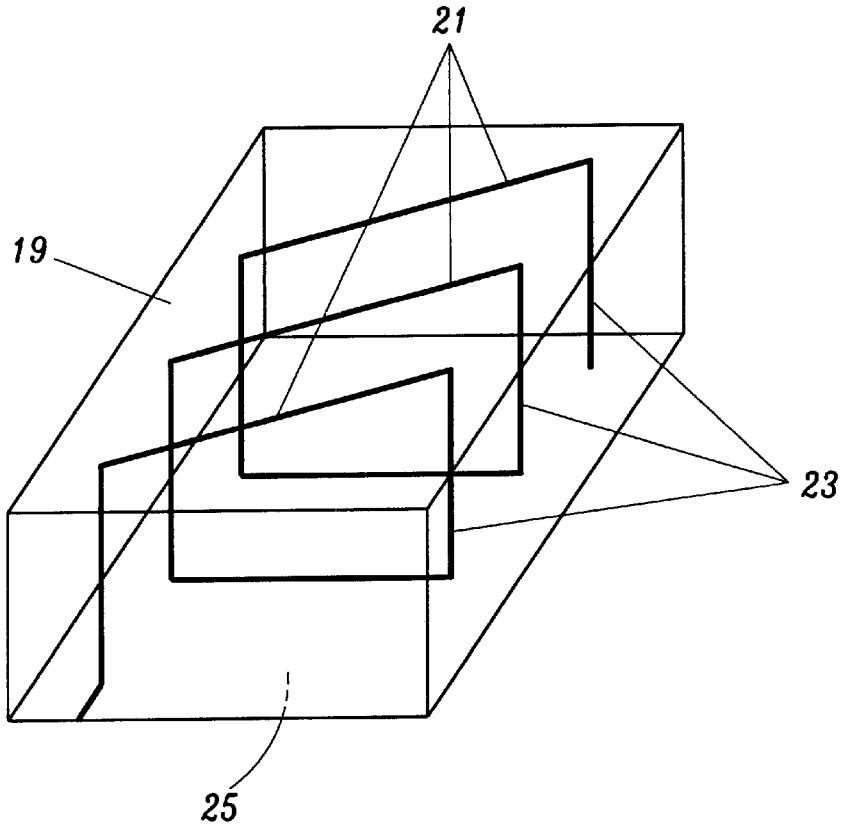
FIG.2 (PRIOR ART)
FIG. 2 is a perspective view of a conventional ceramic chip antenna.
Figure 3:
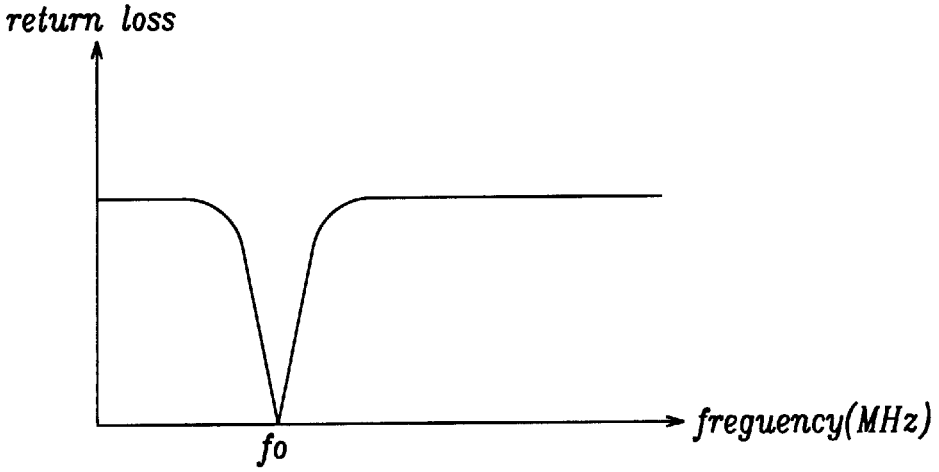
FIG.3 (PRIOR ART)
FIG. 3 is a return loss vs. frequency graph of the ceramic chip antenna.
Figure 4:
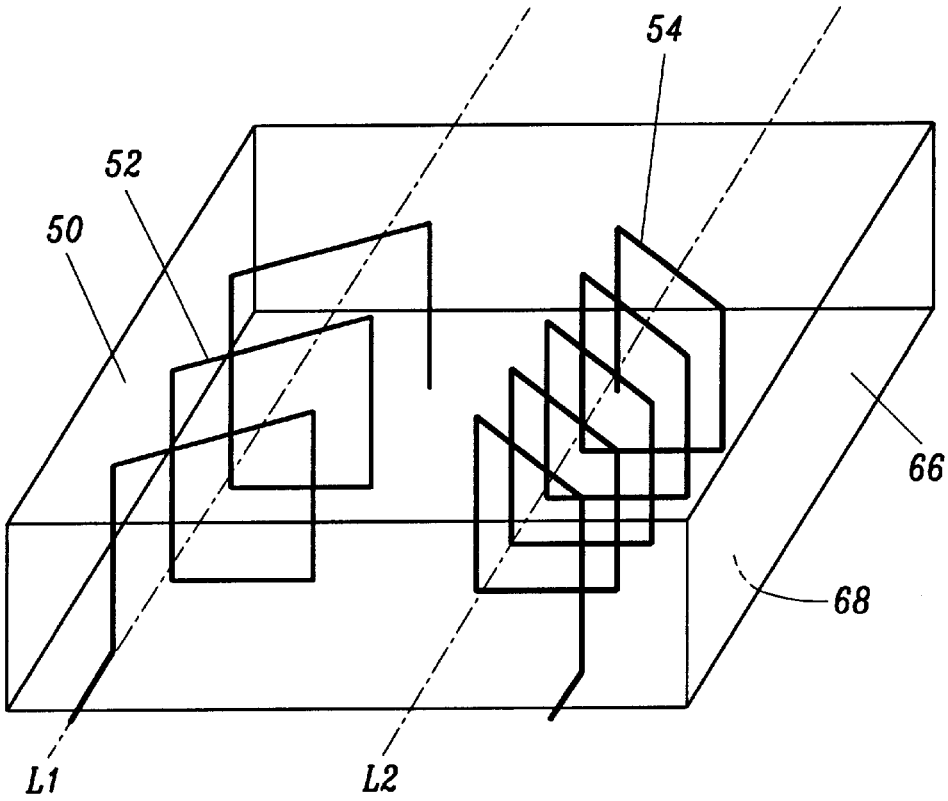
FIG. 4 is a perspective view of a ceramic chip antenna in accordance with the first preferred embodiment of the present invention.
Figure 5:
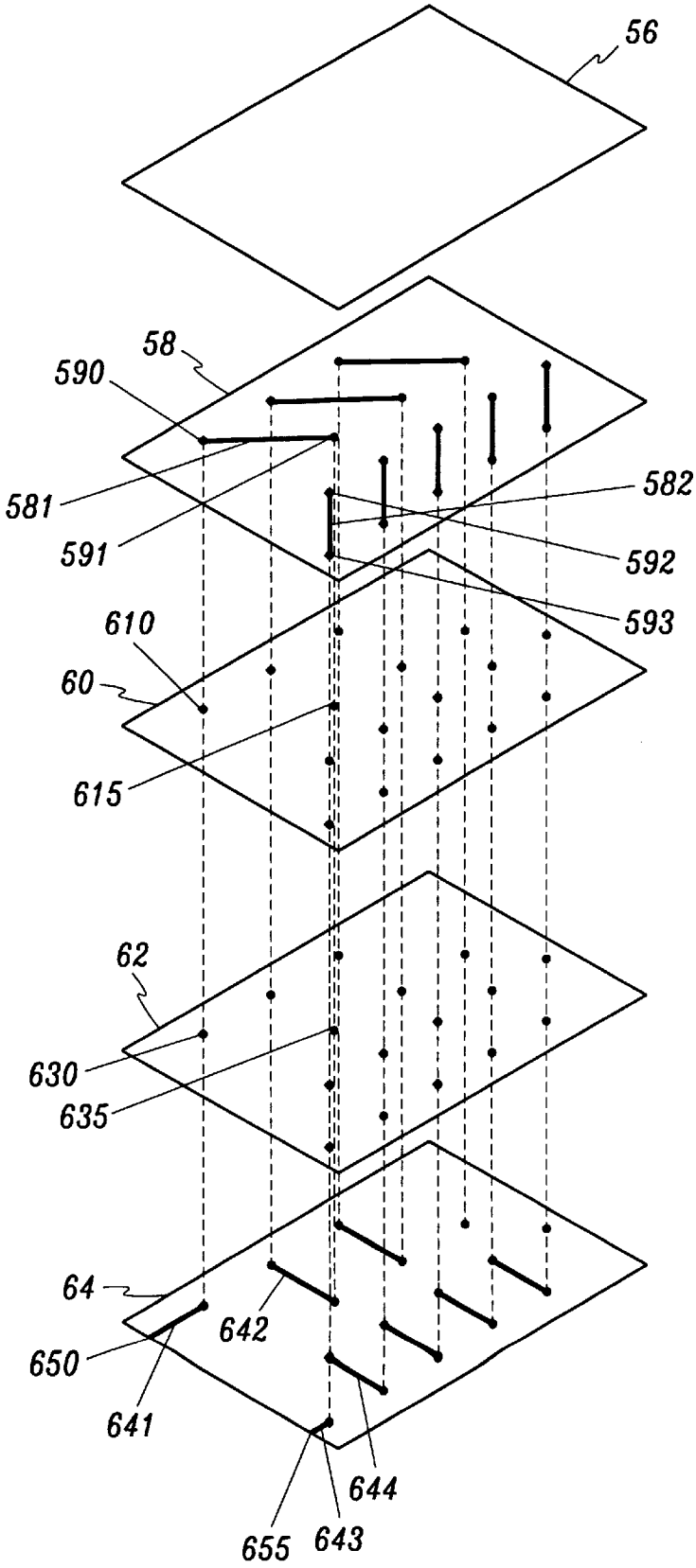
FIG. 5 is an exploded perspective view of a ceramic chip antenna of FIG. 4.
Figure 6:
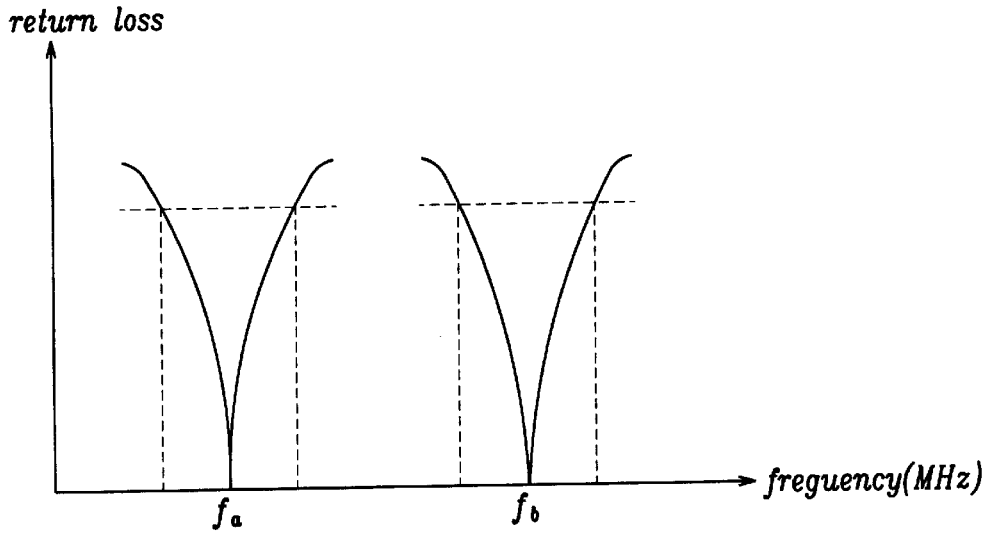
FIG. 6 is a return loss vs. frequency graph of the ceramic chip antenna of FIG. 4.

FIG. 4 is a perspective view of a ceramic chip antenna in accordance with the first preferred embodiment of the present invention. FIG. 5 is an exploded perspective view of a ceramic chip antenna of FIG. 4. FIG. 6 is a return loss vs. frequency graph of the ceramic chip antenna of FIG. 4.

A ceramic chip antenna comprises a dielectric chip base 50 formed as a rectangular parallelepiped and a first helical conductor 52 which is spirally wound within the dielectric chip base 50. Further, the ceramic chip antenna comprises a second helical conductor 54 which is spirally wound within the dielectric chip base 50 and is separated from the first helical conductor 52.

The dielectric chip base 50 is formed by stacking together rectangular dielectric ceramic sheets 56, 58, 60, 62, and 64 which are formed of a ceramic mixture whose main components are LTCC(low temperature cofiring ceramics) based on glass ceramics.

Here, the dielectric ceramic sheets 58 and 64 have on their surfaces conductive strip patterns 581, 582, 641, 642, 643, and 644 formed by printing. Via holes 590, 591, 592, and 593 formed so as to extend in the thickness direction, are provided on both ends of the conductive strip patterns 581 and 582. Further, via holes 610 and 615, 630, and 635 are formed on the dielectric ceramic sheets 60 and 62. By stacking the dielectric ceramic sheets 56, 58, 60, 62, and 64 together and connecting the conductive strip patterns 581, 641, and 642 through the via holes 590, 591, 610, 615, 630, and 635, the first helical conductors 52 is spirally formed. Similarly, by stacking the dielectric ceramic sheets 56, 58, 60, 62, and 64 together and connecting the conductive strip patterns 582, 643, and 644 through the via holes 592 and 593, the second helical conductors 54 is spirally formed. The helical conductors 52 and 54 are electrically connected because the via holes 590, 591, 592, 593, 610, 615, 630, and 635 are filled with electrically conductive paste before the stacking operation. The electrically conductive paste is composed of conductive phase, binder, vehicle, and additives.

One end of the first helical conductor 52, that is, one end of the conductive strip pattern 641 is led to an outside surface of the dielectric chip base 50 to form a feeding terminal 650 for applying a signal to the first helical conductor 52. Similarly, one end of the first helical conductor 54, that is, one end of the conductive strip pattern 643 is led to an outside surface of the dielectric ceramic base 50 to form a feeding terminal 655 for applying a signal to the first helical conductor 54.

A winding axis L1 of the first helical conductor 52 is respectively parallel to a bottom surface 68 and a side surface 66 of the ceramic chip base 50. Also, a winding axis L2 of the second helical conductor 54 is respectively parallel to a bottom surface 68 and a side surface 66 of the dielectric chip base 50. Accordingly, each of the winding axes L1 and L2 is parallel each other. Further, the first helical conductor 52 and the second helical conductor 54 are not connected each other.

A shape of the winding cross section which is perpendicular to the winding axis L1 of the first helical conductor 52 is a rectangular. Similarly, a shape of the winding cross section which is perpendicular to the winding axis L2 of the second helical conductor 54 is also a rectangular.

The conductive strip patterns 581, 582, 641, 642, 643, and 644 and the via holes 590, 591, 592, 593, 610, 615, 630, and 635 on the dielectric ceramic sheets 56, 58, 60, and 62 are three-dimensionally connected through a precise alignment in order to form the helical conductors 52 and 54. Further, the dielectric chip base 50 is formed by compressing and cofiring the precisely aligned dielectric ceramic sheets 56, 58, 60, 62, and 64.

A first resonating frequency is determined by the number of turnings of, the interval of turnings of, and the length of the first helical conductor 52. Similarly, a second resonating frequency is determined by the number of turnings of, the interval of turnings of, and the length of the second helical conductor 54. Accordingly, the resonating frequencies are changed if the number of turnings of, the interval of turnings of, and the length of the helical conductors 52 and 54 are changed. Consequently, if the first resonating frequency is different from the second resonating frequency, the ceramic chip antenna is capable of utilizing two bands.

As shown in FIG. 6, a graph shows a rather sharp peak in return power loss at a first predetermined frequency fa and a second predetermined frequency fb. Accordingly, the ceramic chip antenna resonates at two frequencies, namely at the frequency fa and the frequency fb because the first helical conductor 54 resonates at the frequency fb and the second helical conductor 52 resonates at the frequency fa. For example, if the first resonating frequency is 1,800 MHz and the second resonating frequency is 900 MHz, the first helical conductor 52 resonates at 1,800 MHz and the second helical conductor 54 resonates at 900 MHz. Accordingly, the ceramic chip antenna operates in a total bandwidth of 900 MHz between 900 MHz and 1,800 MHz. Consequently, the ceramic chip antenna is capable of utilizing two bands and is usable for operating in a relatively wide bandwidth.

A shape of the winding cross section of the helical conductors 52 and 54 is not limited to being a rectangle. It may also be circular, semicircular, and so forth in shape.

Further, although the helical conductors 52 and 54 are formed within the dielectric chip base 50 according to the first preferred embodiment of the present invention, it is also possible to form the helical conductors by printing the conductive strip patterns on the surface of the dielectric chip base 50.

Figure 7:
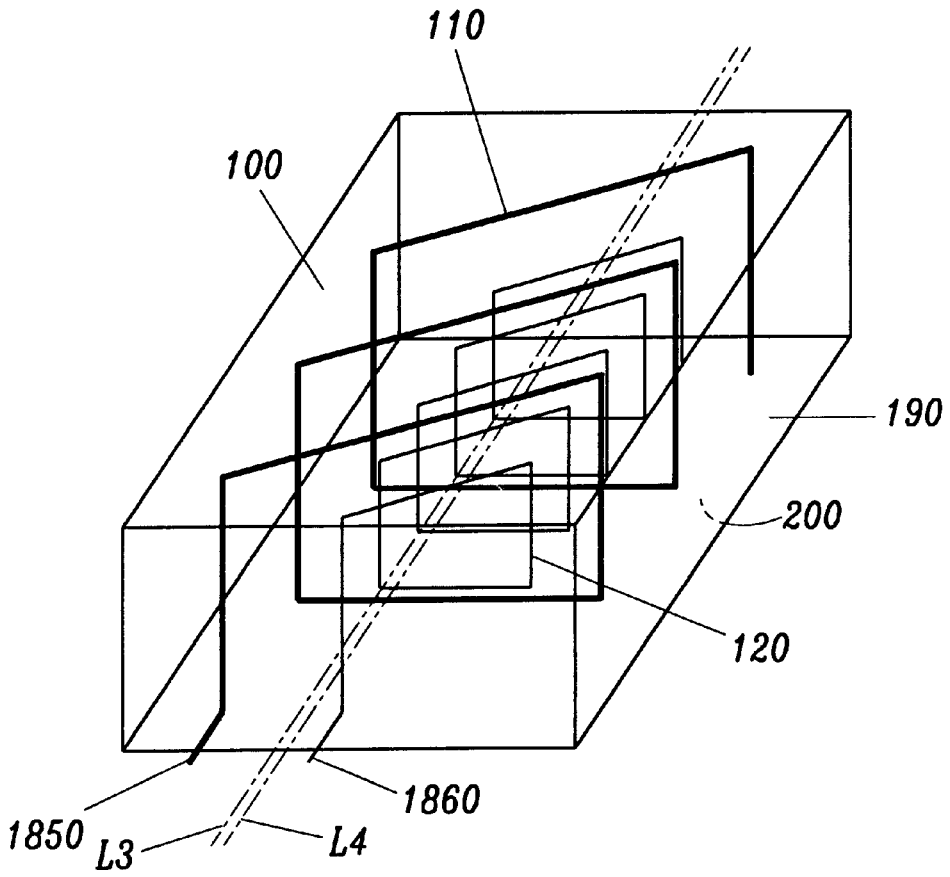
FIG. 7 is a perspective view of a ceramic chip antenna in accordance with the second preferred embodiment of the present invention.
Figure 8:
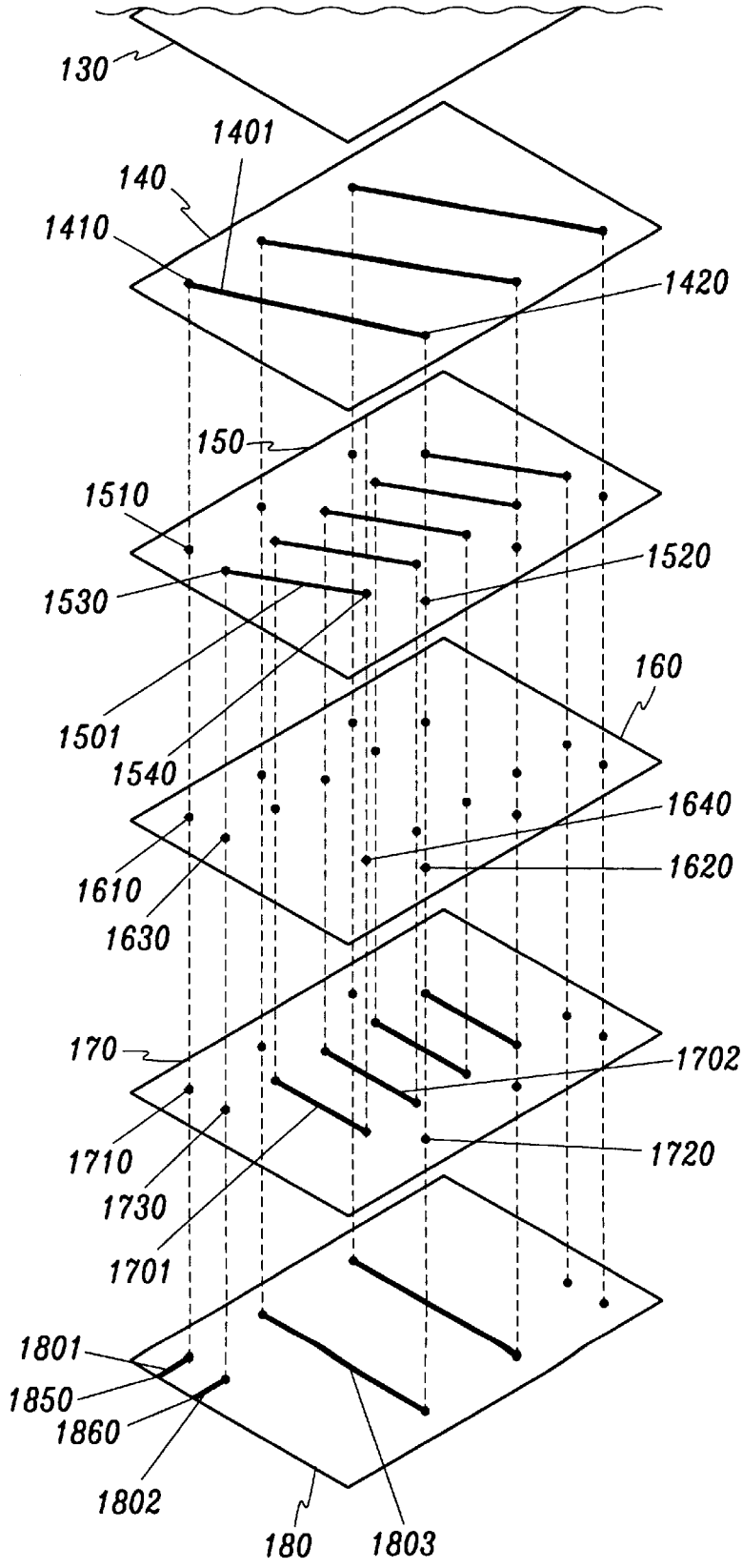
FIG. 8 is an exploded perspective view of a ceramic chip antenna of FIG. 7.
Figure 9:
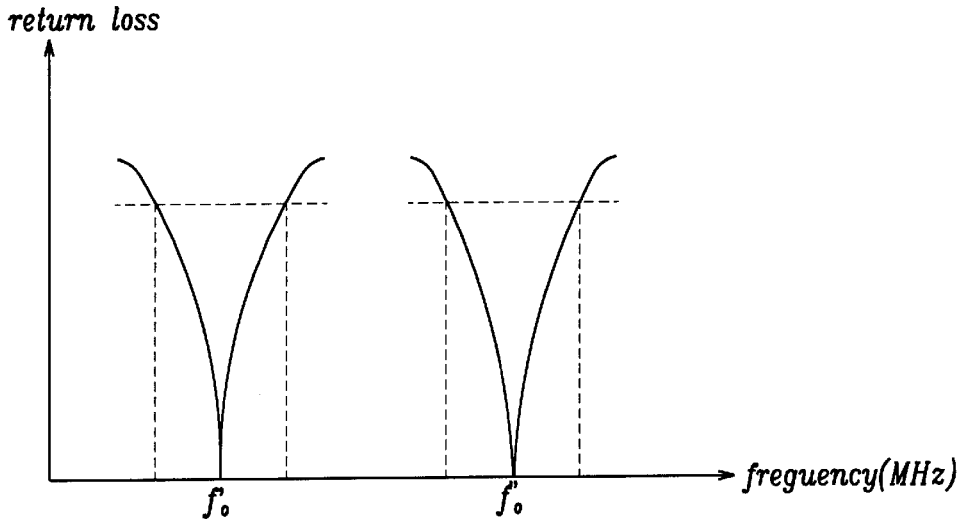
FIG. 9 is a return loss vs. frequency graph of the ceramic chip antenna of FIG. 8.

FIG. 7 is a perspective view of a ceramic chip antenna in accordance with the second preferred embodiment of the present invention. FIG. 8 is an exploded perspective view of a ceramic chip antenna of FIG. 7. FIG. 9 is a return loss vs. frequency graph of the ceramic chip antenna of FIG. 7.

A ceramic chip antenna comprises a dielectric chip base 100 formed as a rectangular parallelepiped and a third helical conductor 110 which is spirally wound within the dielectric chip base 100. Further, the ceramic chip antenna comprises a fourth helical conductor 120 which is spirally wound within the third helical conductor 110 and is separated from the third helical conductor 110.

The dielectric chip base 100 is formed by stacking together rectangular dielectric ceramic sheets 130, 140, 150, 160, 170, and 180.

Here, the dielectric ceramic sheets 140, 150, 170, and 180 have on their surfaces conductive strip patterns 1401, 1501, 1701, 1801, 1802, and 1803 formed by printing. Via holes 1410 and 1420 formed so as to extend in the thickness direction, are provided on both ends of the conductive strip pattern 1401. Further, via holes 1530 and 1540 are provided on both ends of the conductive strip pattern 1501 and via holes 1510 and 1520 are formed on the dielectric ceramic sheet 150. Also, via holes 1610, 1620, 1630, and 1640 are formed on the dielectric ceramic sheet 160 and via holes 1710 and 1720 are formed on the dielectric ceramic sheet 170. By stacking the dielectric ceramic sheets 130, 140, 150, 160, 170, and 180 together and connecting the conductive strip patterns 1401, 1801, and 1803 through the via holes 1410, 1420, 1510, 1520, 1610, 1620, 1710, and 1720, the third helical conductors 110 is spirally formed. Similarly, by stacking the dielectric ceramic sheets 130, 140, 150, 160, 170, and 180 together and connecting the conductive strip patterns 1501, 1701, and 1802 through the via holes 1530, 1540, 1630, 1640, and 1730, the fourth helical conductors 120 is spirally formed. The third helical conductor 110 is electrically connected because the via holes 1410, 1420, 1510, 1520, 1610, 1620, 1710, and 1720 are filled with electrically conductive paste before the stacking operation. Similarly, the fourth helical conductor 120 is also electrically connected because the via holes 1530, 1540, 1630, 1640, and 1730 are filled with electrically conductive paste before the stacking operation.

One end of the third helical conductor 110, that is, one end of the conductive strip pattern 1801 is led to an outside surface of the dielectric chip base 100 to form a feeding terminal 1850 for applying a signal to the third helical conductor 110. Similarly, one end of the fourth helical conductor 120, that is, one end of the conductive strip pattern 1802 is led to an outside surface of the dielectric ceramic base 100 to form a feeding terminal 1860 for applying a signal to the fourth helical conductor 120.

A winding axis L3 of the third helical conductor 110 is respectively parallel to a bottom surface 200 and a side surface 190 of the ceramic chip base 100. Also, a winding axis L4 of the fourth helical conductor 120 is respectively parallel to a bottom surface 200 and a side surface 190 of the dielectric chip base 100. Accordingly, the winding axes L3 and L4 are parallel and coincide with each other. However, the winding axes L3 and L4 are not limited to coincide with each other. Further, the third helical conductor 110 and the fourth helical conductor 120 are not connected each other.

A shape of the winding cross section which is perpendicular to the winding axis L3 of the third helical conductor 110 is a rectangular. Similarly, a shape of the winding cross section which is perpendicular to the winding axis L4 of the fourth helical conductor 54 is also a rectangular.

The conductive strip patterns 1401, 1801, and 1803 and the via holes 1410, 1420, 1510, 1520, 1610, 1620, 1710, and 1720 on the dielectric ceramic sheets 140, 150, 160, and 170 are three-dimensionally connected through a precise alignment in order to form the third helical conductor 110. Further, the conductive strip patterns 1501, 1701, and 1802 and the via holes 1530, 1540, 1630, and 1640 on the dielectric ceramic sheets 150 and 160 are three-dimensionally connected through a precise alignment in order to form the fourth helical conductor 120. The dielectric chip base 100 is formed by compressing and cofiring the precisely aligned dielectric ceramic sheets 130, 140, 150, 160, 170, and 180.

A third resonating frequency is determined by the number of turnings of, the interval of turnings of, and the length of the third helical conductor 110. Similarly, a fourth resonating frequency is determined by the number of turnings of, the interval of turnings, and the length of the fourth helical conductor 120. Accordingly, the resonating frequencies are changed if the number of turnings of, the interval of turnings of, and the length of the helical conductors 110 and 120 are changed. Consequently, if the third resonating frequency is different form the fourth resonating frequency, the ceramic chip antenna is capable of utilizing two bands.

As shown in FIG. 9, a graph shows a rather sharp peak in return power loss at a third predetermined frequency f'o and a fourth predetermined frequency f"o. Accordingly, the ceramic chip antenna resonates at two frequencies, namely at the frequency f'o and the frequency f"o because the third helical conductor 110 resonates at the frequency f'o and the fourth helical conductor 120 resonates at the frequency f"o. For example, if the third resonating frequency is 1,800 MHz and the fourth resonating frequency is 900 MHz, the third helical conductor 110 resonates at 1,800 MHz and the fourth helical conductor 120 resonates at 900 MHz. Accordingly, the ceramic chip antenna operates in a total bandwidth of 900 MHz between 900 MHz and 1,800 MHz. Consequently, the ceramic chip antenna is capable of utilizing two bands and is usable for operating in a relatively wide bandwidth.

A shape of the winding cross section of the helical conductors 110 and 120 is not limited to being a rectangle. It may also be circular, semicircular, and so forth in shape.

Further, although the helical conductors 110 and 120 are formed within the dielectric chip base 100 according to the second preferred embodiment of the present invention, it is also possible to form the helical conductors by printing the conductive strip patterns on the surface of the dielectric chip base 100.

Figure 10:
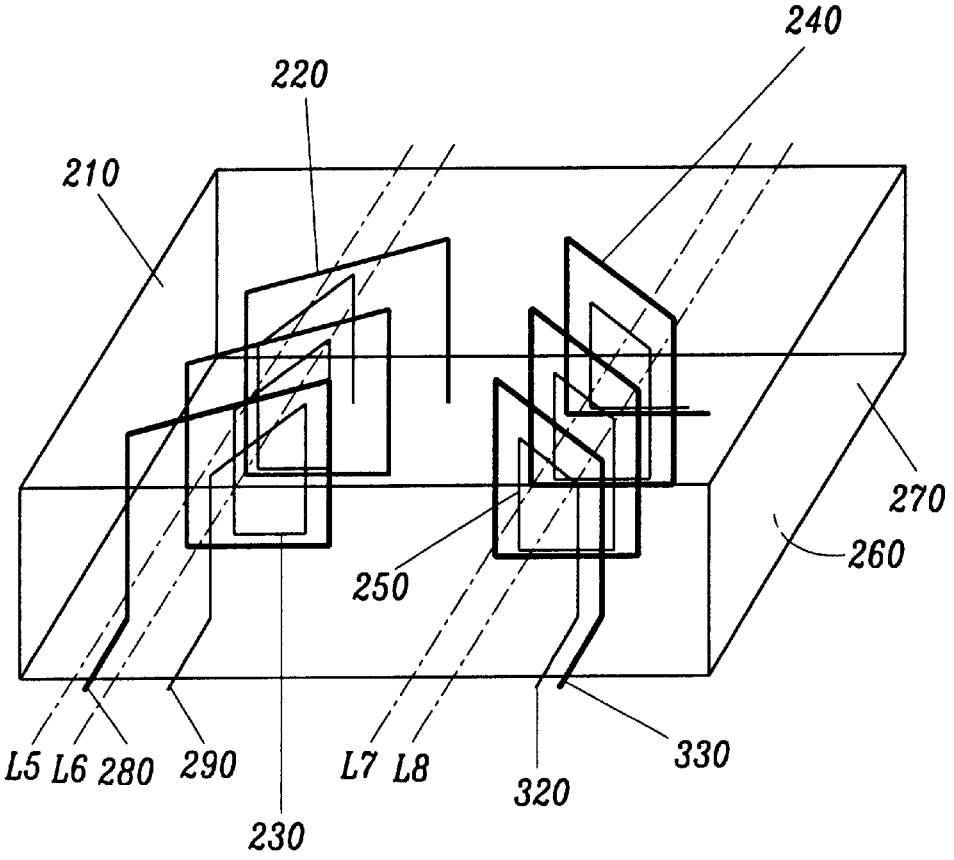
FIG. 10 is a perspective view of a ceramic chip antenna in accordance with the third preferred embodiment of the present invention.
Figure 11:
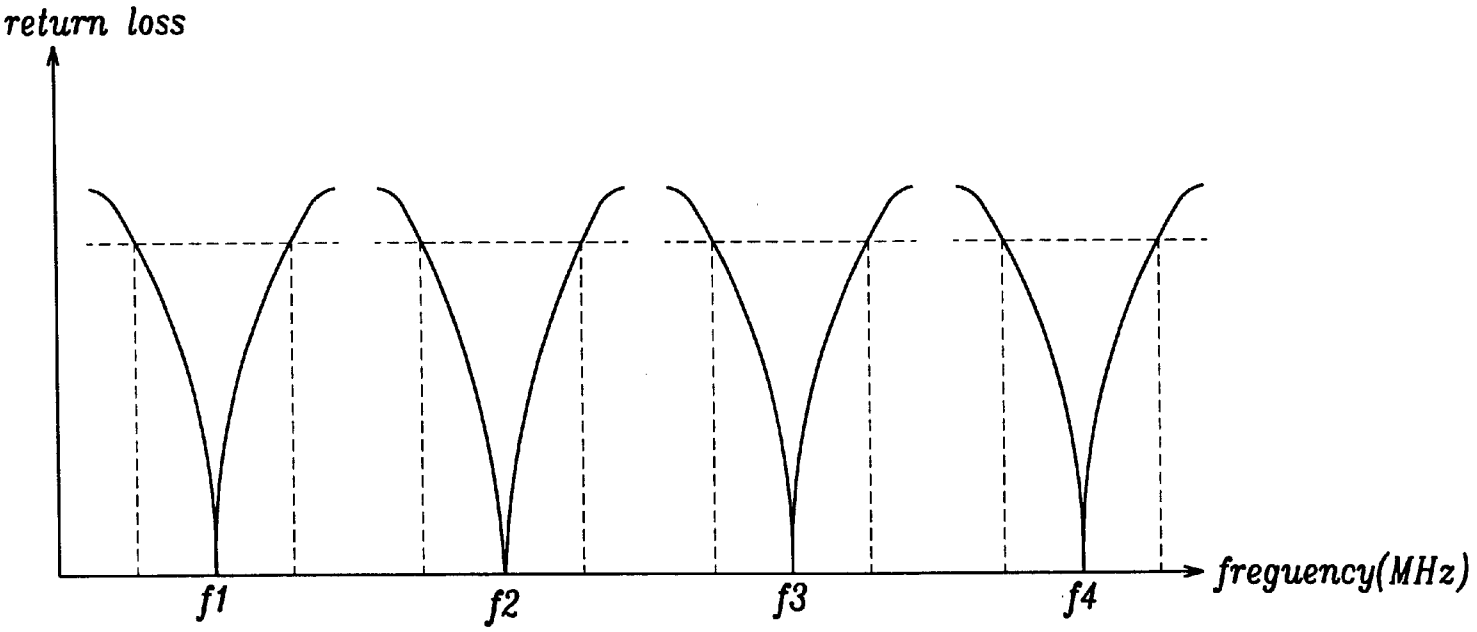
FIG. 11 is a return loss vs. frequency graph of the ceramic chip antenna of FIG. 10.

FIG. 10 is a perspective view of a ceramic chip antenna in accordance with the third preferred embodiment of the present invention and FIG. 11 is a return loss vs. frequency graph of the ceramic chip antenna of FIG. 10.

A ceramic chip antenna comprises a dielectric chip base 210 formed as a rectangular parallelepiped and four helical conductors 220, 230, 240, and 250 which is spirally wound within the dielectric chip base 210.

Because the third preferred embodiment of the present invention is similar to the combination of the first preferred embodiment and the second preferred embodiment of the present invention, the third preferred embodiment will be directed in particular to the four helical conductors 220, 230, 240, and 250.

The four helical conductors 220, 230, 240, and 250 are divided into two pairs. The first pair has the helical conductor 220 and 230 and the second pair has the helical conductor 240 and 250. The sixth helical conductor 230 is spirally wound within the fifth helical conductor 220 and the eighth helical conductor 250 is spirally wound within the seventh helical conductor 240.

One ends of the four helical conductors 220, 230, 240, and 250 are led to an outside surface of the dielectric chip base 210 to form a feeding terminals 280, 290, 320, and 330 for applying a signal to the four helical conductors 220, 230, 240, and 250.

Each of winding axes L5, L6, L7, and L8 of the four helical conductors 220, 230, 240, and 250 is respectively parallel to a bottom surface 260 and a side surface 270 of the dielectric chip base 210. Accordingly, the winding axes L5 and L6 are parallel each other and coincide with each other. Also, the winding axes L7 and L8 are parallel and coincide with each other. However, the winding axes L5 and L6 are not limited to coincide with each other. Similarly, the winding axes L7 and L8 are also not limited to coincide with each other. Further, the four helical conductors 220, 230, 240, and 250 are not connected each other.

A shape of the winding cross section which is perpendicular to the winding axis L5 of the fifth helical conductor 220 is a rectangular. Further, it is the same to the three helical conductors 230, 240, and 250.

The four resonating frequencies are different each other if the number of turnings of, the interval of turnings of, and the length of the four helical conductors 220, 230, 240, and 250 are respectively different. Consequently, the ceramic chip antenna is capable of utilizing four bands.

As shown in FIG. 11, a graph shows a rather sharp peak in return power loss at a fifth predetermined frequency f1, a sixth predetermined frequency f2, a seventh predetermined frequency f3, and a eighth predetermined frequency f4. Accordingly, the ceramic chip antenna resonates at four frequencies, namely at the frequency f1, the frequency f2, the frequency f3 and the frequency f4 because the fifth helical conductor 220 resonates at the frequency f1, the sixth helical conductor 230 resonates at the frequency f2, the seventh helical conductor 240 resonates at the frequency f3 and the eighth helical conductor 250 resonates at the frequency f4. Consequently, the ceramic chip antenna is capable of utilizing four bands and is usable for operating in a wide bandwidth.

As described above, since spirally wound conductors operating at each other different frequencies is formed within a dielectric chip base, a ceramic chip antenna is capable of utilizing a plurality of bands and is sufficiently small to be formed within a portable transceiver. Further, the ceramic chip antenna is usable for operating in a relatively wide bandwidth.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A ceramic chip antenna comprising:

a dielectric chip base;

at least one conductor which is spirally wound within said dielectric chip base; and at least one sub conductor which is spirally wound within said conductor such that said conductor and said sub conductor are respectively separated, and wherein one end of said conductor is led to an outside surface of said dielectric base to form a feeding terminal for applying a signal to said conductor, and one end of said sub conductor is led to an outside surface of said dielectric base to form a feeding terminal for applying a signal to said sub conductor.

2. The ceramic chip antenna of claim 1, wherein said dielectric chip base is formed as a rectangular parallelepiped.

3. The ceramic chip antenna of claim 2, wherein a winding axis of said conductor and said sub conductor is respectively parallel to a bottom surface and a side surface of said dielectric chip base.

4. The ceramic chip antenna of claim 3, wherein a winding axis of said conductor coincides with a winding axis of each of said sub conductor within said conductor.

5. The ceramic chip antenna of claim 4, wherein a shape of the winding cross section, which is perpendicular to a winding axis of said conductor, is rectangular.

6. The ceramic chip antenna of claim 4, wherein a shape of the winding cross section, which is perpendicular to a winding axis of said sub conductor, is rectangular.

7. The ceramic chip antenna of claim 1, wherein said dielectric chip base is formed by stacking together a plurality of dielectric ceramic sheets.

8. A method of manufacturing a ceramic chip antenna comprising the steps of:

providing a plurality of dielectric ceramic sheets;

depositing conductive strip patterns on a first set of dielectric ceramic sheets, wherein the conductive strip patterns define horizontal portions of a conductor;

depositing conductive strip patterns on a second set of dielectric ceramic sheets, wherein the conductive strip patterns define horizontal portions of a sub conductor;

forming vertical holes through at least some of the dielectric ceramic sheets; and assembling the dielectric ceramic sheets into a ceramic chip antenna, wherein said assembling step comprises:

filling the vertical holes with electrically conductive paste;

stacking the dielectric ceramic sheets on top of each other such that the conductive strip patterns and vertical holes of the dielectric ceramic sheets define a sub conductor that is spirally wound within a conductor, wherein the conductor and sub conductor are separated, and wherein one end of the conductor and one end of said sub conductor are led to an outside surface of the ceramic chip antenna to form feeding terminals for applying signals to the conductor and sub conductor; and forming the ceramic chip antenna from the dielectric ceramic sheets.

9. A method according to claim 8 further comprising after said stacking step the step of aligning the ceramic sheets such that the vertical holes and the conductive strips are in electrical contact to thereby form the conductor and sub conductor.

10. A method according to claim 8, wherein said steps of depositing conductive strip patterns comprises depositing conductive strip patterns on the first and second sets of dielectric ceramic sheets such that when the dielectric ceramic sheets are stacked in said stacking step a winding axis of the conductor and a winding axis of the sub conductor are respectively parallel to a bottom surface and a side surface of the ceramic chip antenna.

11. A method according to claim 8, wherein said steps of depositing conductive strip patterns comprises depositing conductive strip patterns on the first and second sets of dielectric ceramic sheets such that when the dielectric ceramic sheets are stacked in said stacking step a winding axis of the conductor coincides with a winding axis of the sub conductor.

12. A method according to claim 8, wherein said step of depositing conductive strip patterns on a first set of dielectric ceramic sheets comprises depositing conductive strip patterns on a first set of dielectric ceramic sheets such that when the dielectric ceramic sheets are stacked in said stacking step, a winding cross section of the conductor is rectangular.

13. A method according to claim 8, wherein said step of depositing conductive strip patterns on a second set of dielectric ceramic sheets comprises depositing conductive strip patterns on a second set of dielectric ceramic sheets such that when the dielectric ceramic sheets are stacked in said stacking step, a winding cross section of the sub conductor is rectangular.

14. A method according to claim 8, wherein said forming step comprises the steps of compressing the dielectric sheets and cofiring the compressed dielectric sheets to form a ceramic chip antenna.

* * * * *